US009162118B2

(12) United States Patent
Mitzel

(10) Patent No.: US 9,162,118 B2
(45) Date of Patent: Oct. 20, 2015

(54) GOLF CLUB HEAD WITH CHANNEL AND STABILIZING STRUCTURE

(71) Applicant: Cobra Golf Incorporated, Carlsbad, CA (US)

(72) Inventor: Steven M. Mitzel, San Marcos, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 14/254,246

(22) Filed: Apr. 16, 2014

(65) Prior Publication Data

US 2014/0342847 A1 Nov. 20, 2014

Related U.S. Application Data

(60) Provisional application No. 61/824,092, filed on May 16, 2013.

(51) Int. Cl.
*A63B 53/04* (2015.01)
*A63B 49/06* (2006.01)

(52) U.S. Cl.
CPC ..... *A63B 53/0466* (2013.01); *A63B 49/06* (2013.01); *A63B 2053/0408* (2013.01); *A63B 2053/0433* (2013.01); *A63B 2225/01* (2013.01)

(58) Field of Classification Search
CPC ..... A63B 2053/0433; A63B 53/0466
USPC ..... 473/345, 349, 350, 344
See application file for complete search history.

(56) References Cited

U.S. PATENT DOCUMENTS

| | | | |
|---|---|---|---|
| 1,835,718 | A | 12/1931 | Morton |
| 4,398,965 | A | 8/1983 | Campau |
| 5,603,668 | A | 2/1997 | Antonious |
| 5,735,754 | A | 4/1998 | Antonious |
| 6,339,869 | B1 | 1/2002 | Peterson |
| 6,422,951 | B1 | 7/2002 | Burrows |
| 6,558,271 | B1 | 5/2003 | Beach et al. |
| 6,595,871 | B2 | 7/2003 | Sano |
| 6,645,087 | B2 | 11/2003 | Yabu |
| 6,773,359 | B1 | 8/2004 | Lee |
| 6,783,465 | B2 | 8/2004 | Matsunaga |
| 6,846,246 | B2 | 1/2005 | Asplund et al. |
| 6,852,038 | B2 | 2/2005 | Yabu |
| 6,887,165 | B2 | 5/2005 | Tsurumaki |
| 7,051,416 | B2 | 5/2006 | Yabu |
| 7,056,228 | B2 | 6/2006 | Beach et al. |
| 7,163,467 | B1 | 1/2007 | Chang et al. |
| 7,247,103 | B2 | 7/2007 | Beach et al. |
| 7,294,064 | B2 | 11/2007 | Tsurumaki et al. |
| 7,390,271 | B2 | 6/2008 | Yamamoto |
| 7,396,293 | B2 | 7/2008 | Soracco |

(Continued)

*Primary Examiner* — Benjamin Layno
(74) *Attorney, Agent, or Firm* — Brown Rudnick LLP; Mark S. Leonardo

(57) ABSTRACT

The invention generally relates to a golf club with a channel area. The channel area includes a groove disposed alongside a ramp having a shallow slope with respect to the horizontal when the club head is at address. The channel area may extend across a portion of the club head such as the crown or the sole. The ramp is oriented such that, during a high speed drive, the ramped portion of the sole may distribute and neutralize torsional stresses, dampening unwanted and unpredictable twisting, preventing the ball from flying in unpredictable directions while the deeper groove contributes to a high coefficient of restitution of a ball-striking face, a large sweet spot area, or both, thus causing the ball to fly a long distance.

10 Claims, 8 Drawing Sheets

(56) References Cited

U.S. PATENT DOCUMENTS

| | | | | |
|---|---|---|---|---|
| 7,396,298 | B2 | 7/2008 | Jertson et al. | |
| 7,448,961 | B2 | 11/2008 | Lin | |
| 7,452,287 | B2 | 11/2008 | Erickson et al. | |
| 7,462,109 | B2 | 12/2008 | Erickson et al. | |
| 7,470,201 | B2 | 12/2008 | Nakahara et al. | |
| 7,500,924 | B2 | 3/2009 | Yokota | |
| 7,572,193 | B2 | 8/2009 | Yokota | |
| 7,578,756 | B2 | 8/2009 | Erickson et al. | |
| 7,582,024 | B2 | 9/2009 | Shear | |
| 7,585,233 | B2 | 9/2009 | Horacek et al. | |
| 7,641,568 | B2 | 1/2010 | Hoffman et al. | |
| 7,749,104 | B2 | 7/2010 | Brekke et al. | |
| 7,803,067 | B2 | 9/2010 | Horacek et al. | |
| 7,850,545 | B2 | 12/2010 | Wada et al. | |
| 7,857,711 | B2 | 12/2010 | Shear | |
| D631,119 | S | 1/2011 | Albertsen et al. | |
| 7,887,433 | B2 | 2/2011 | Hoffman et al. | |
| 7,988,565 | B2 | 8/2011 | Abe | |
| 7,998,000 | B2 | 8/2011 | Brekke et al. | |
| 8,029,385 | B2 | 10/2011 | Horacek et al. | |
| 8,226,500 | B2 | 7/2012 | Yamamoto et al. | |
| 8,235,841 | B2 | 8/2012 | Stites et al. | |
| 8,235,844 | B2 | 8/2012 | Albertsen et al. | |
| 8,241,143 | B2 | 8/2012 | Albertsen et al. | |
| 8,241,144 | B2 | 8/2012 | Albertsen et al. | |
| 8,328,659 | B2 | 12/2012 | Shear | |
| 8,353,782 | B1 | 1/2013 | Beach et al. | |
| 8,529,368 | B2 | 9/2013 | Rice et al. | |
| 2002/0183134 | A1 | 12/2002 | Allen et al. | |
| 2004/0192463 | A1 | 9/2004 | Tsurumaki et al. | |
| 2007/0026961 | A1 | 2/2007 | Hou | |
| 2007/0117648 | A1 | 5/2007 | Yokota | |
| 2012/0135821 | A1* | 5/2012 | Boyd et al. | 473/342 |
| 2012/0142447 | A1 | 6/2012 | Boyd et al. | |
| 2012/0142452 | A1 | 6/2012 | Burnett et al. | |
| 2012/0143452 | A1 | 6/2012 | Jung et al. | |
| 2012/0196703 | A1 | 8/2012 | Sander | |
| 2012/0220387 | A1 | 8/2012 | Beach et al. | |
| 2012/0244960 | A1 | 9/2012 | Tang et al. | |
| 2012/0270676 | A1 | 10/2012 | Burnett et al. | |
| 2012/0277029 | A1 | 11/2012 | Albertsen et al. | |
| 2012/0277030 | A1 | 11/2012 | Albertsen et al. | |
| 2013/0029779 | A1 | 1/2013 | Stites et al. | |
| 2013/0102408 | A1 | 4/2013 | Shear | |
| 2014/0080633 | A1* | 3/2014 | Bezilla et al. | 473/342 |

* cited by examiner

GOLF CLUB HEAD WITH CHANNEL AND STABILIZING STRUCTURE

This application claims the benefit of, and priority to, U.S. Provisional Application 61/824,092, filed May 16, 2013, the contents of which are incorporated by reference.

FIELD OF THE INVENTION

1. Field of the Invention

The invention generally relates to a golf club head with a channel area in the sole to contribute to straight, long-distance drives.

2. Background

When people play golf, they would like to be able to hit a golf ball a long distance in the right direction. Driver-style golf clubs are designed to a have a large face with a sweet spot that hits the ball far. Club designers have tried different structures in attempts to improve the sweet spot and hitting distance of drivers. For example, U.S. Pat. No. 7,294,064 to Tsurumaki shows an elastically deformable groove or recess to increase coefficient of restitution and move sweet spot downwards. Other clubs with some such feature are shown in U.S. Pat. No. 8,529,368 to Rice; U.S. Pat. No. 7,582,024 to Shear; U.S. Pat. No. 7,572,193 to Yokota; U.S. Pat. No. 7,500,924 to Yokota; U.S. Pat. No. 7,396,293 to Soracco; U.S. Pat. No. 6,887,165 U.S. Pat. No. 5,735,754 to Antonious; U.S. Pat. No. 5,603,668 to Antonious; U.S. Pat. No. 1,835,718 to Morton; U.S. Pub. 2013/0029779 to Stites; U.S. Pub. 2012/0143452 to Burnet; U.S. Pub. 2012/0142447 to Boyd; U.S. Pub. 2012/0196703 to Sander; U.S. Pub. 2012/0244960 to Tang; U.S. Pub. 2012/0220387 to Beach; U.S. Pub. 2007/0117648 to Yokota; U.S. Pub. 2007/0026961 to Hou; U.S. Pub. 2004/0192463 to Ando; and U.S. Pub. 2002/0183134 to Allen.

Unfortunately, introducing a structure to accomplish one goal can compromise another. Some golfers find that, despite the distance of their drives, the balls tend to hook or slice unpredictably. In fact, it may be found that prior art club heads with a channel in the sole are notoriously hard to hit, sending the ball in all directions, and thus negating the intended improvement of the channel.

SUMMARY

The invention provides a golf club with a channel that includes a recess set apart from an adjacent sole surface by at least one curved surface defining a ramp disposed at an angle intermediate the orientation of the channel wall and the sole surface. The ramp is oriented such that, during a high speed drive, the ramped portion of the sole may distribute and neutralize torsional stresses, dampening unwanted and unpredictable twisting that can be introduced or amplified by prior art channel structures. One insight of the invention is that adding an elastically deformable channel to a driver head can destabilize the structure, allowing the club head to twist, shear, or compress non-uniformly and transfer momentum non-uniformly to the strike face during the down stroke of a high-speed drive or at impact. A club head may twist or shear because the down stroke stresses the club along certain vectors and the prior art structure is compressible along that vector. An inclined surface, such as a ramp with a shallow slope, can introduce a plane of material extending in parallel to a component of such a vector and that material can resist compression or deformation. Preferably, that first ramp is adjacent another second ramped portion that is sloped in the same direction but at a steeper angle, with an opposed third ramped surface facing the first and second ramped surfaces. Thus a club head that includes a channel area with a groove that is buttressed by a shallow ramp will resist non-uniform deformation and non-uniform momentum transfer to the face with the result that shots will fly straight, and the club head will provide the full and intended benefit of a channel in the sole—a high coefficient of restitution and a large sweet spot in a club head that hits true. The channel area or groove preferably runs in a heel-to-toe direction substantially parallel to the face and close (e.g., within a few centimeters) to the face.

In certain aspects, the invention provides a golf club head having a crown, sole, heel portion, toe portion, and face cooperating to define a club head body. A hosel extends upwards from the body. The club head includes a channel area extending along an outer surface of the sole from the heel portion towards the toe portion. The channel area includes a groove disposed alongside a ramp with a shallow slope with respect to the horizontal when the club head is at address.

The groove may include two opposed, inward-facing walls such as a fore facing inward wall and an aft-facing inward wall. The aft-facing inward wall can have a steep slope with respect to the horizontal when the club head is at address. The shallow slope may be between 5° and 20° and the steep slope is between 20° and 80°. In some embodiments, the shallow slope is between 10° and 20° and the steep slope is between 30° and 60°. A heel-toe length of the channel may be between about 5 cm and about 15 cm. A face-aft width of the channel may be between about 0.2 cm and about 3 cm. A face-aft width of the ramp may between about 0.1 cm and about 1.5 cm.

In some embodiments, the club head is a hollow club head such as a driver, fairway wood, or hybrid.

In certain aspects, the invention provides a golf club head with a crown, sole, heel portion, toe portion, and face cooperating to define a club head body as well as a hosel extending upwards from the body and an inclined surface transitioning from a downward-facing portion of the sole surface to a narrow furrow in the sole. The furrow preferably extends from the heel portion to the toe portion. The inclined surface may extend along substantially an entirety, or only a part, of the furrow. A portion of the inclined surface may contain a portion of an idealized conical surface. The idealized conical surface defines an axis of a cone that is parallel to an axis of percussion of the club head or to a horizontal axis passing in a face-aft direction through a geometric center of face when the club head is at address.

In certain aspects, the invention provides a golf club head with a crown, sole, heel portion, toe portion, and face cooperating to define a club head body as well as a hosel extending upwards from the body and an inclined surface transitioning from a portion of a surface of the club head to a narrow furrow in the club head.

In certain aspects, the invention provides a golf club head that has a crown, sole, heel portion, toe portion, and face cooperating to define a club head body and a hosel extending upwards from the body. A channel extends across a surface of the club head. A cross-sectional profile of a portion of the channel has, when the club head is at address, a gently inclined portion forming a first angle with the horizontal and a steeply inclined portion forming a second angle with the horizontal. Preferably, the channel extends across the sole. In some embodiments, the first angle is between 5° and 20° and the second angle is between 20° and 80°. Preferably, the gently inclined portion and the steeply inclined portion extend for a distance across the sole substantially in a heel-toe direction. That distance may be greater than about 4 cm.

In certain embodiments, the steeply inclined portion provides part of a wall of a groove in the sole. The groove can be substantially parallel to the face and spaced away from the face by at least a setback distance over a majority of a length of the groove. That setback distance may be between about 1 cm and about 5 cm. Preferably, the gently inclined portion is disposed between the face and the groove. In certain embodiments, the groove comprises a depth, with respect to a predominant surface of the sole, between about 1 mm and about 10 mm.

DETAILED DESCRIPTION

The invention provides a golf club head with a structure designed to improve a coefficient of restitution or increase the size of a sweet spot without introducing structural instability into the club head that leads to unpredictable twists and uncontrollable hooking or slicing. Without being bound by any mechanism of action, it is theorized that an elastically deformable groove in a club head can compress non-uniformly during a swing due to torsional stresses introduced during a down-swing (i.e., the club head can squeeze more on one side than the other in a manner similar to the compression of a corridor connection between cars of a passenger train as it rounds a curve). It is possible that the predominantly upright nature of the internal walls of a deformable groove and the narrow connection between them does little to resist non-uniform connection. Accordingly, the invention provides an area of material that is sloped, with respect to the surrounding area of the club head, less than the internal walls of a deformable groove. Specifically, a preferred embodiment includes a groove or slot on the sole that is substantially parallel to the face and that defines at least three surface: two that are opposed, steeply sloped surfaces facing one another, and a third that is gently sloped, providing a transition from the deeper groove to the sole surface. The gently sloped portion allows the deeper groove to still provide its beneficial contribution to sweet spot and coefficient of restitution, but may strongly resist the non-uniform compression and non-uniform momentum transfer to the strike face resulting from torsional stresses of a hard downward swing. A channel area with a gently sloped portion adjacent a deeper groove may be located anywhere on a club head. For example, a channel area may be substantially parallel to a face and extend across a crown or sole (either centered or off-center). In a preferred embodiment, the channel area extends across the sole.

Figure 1:
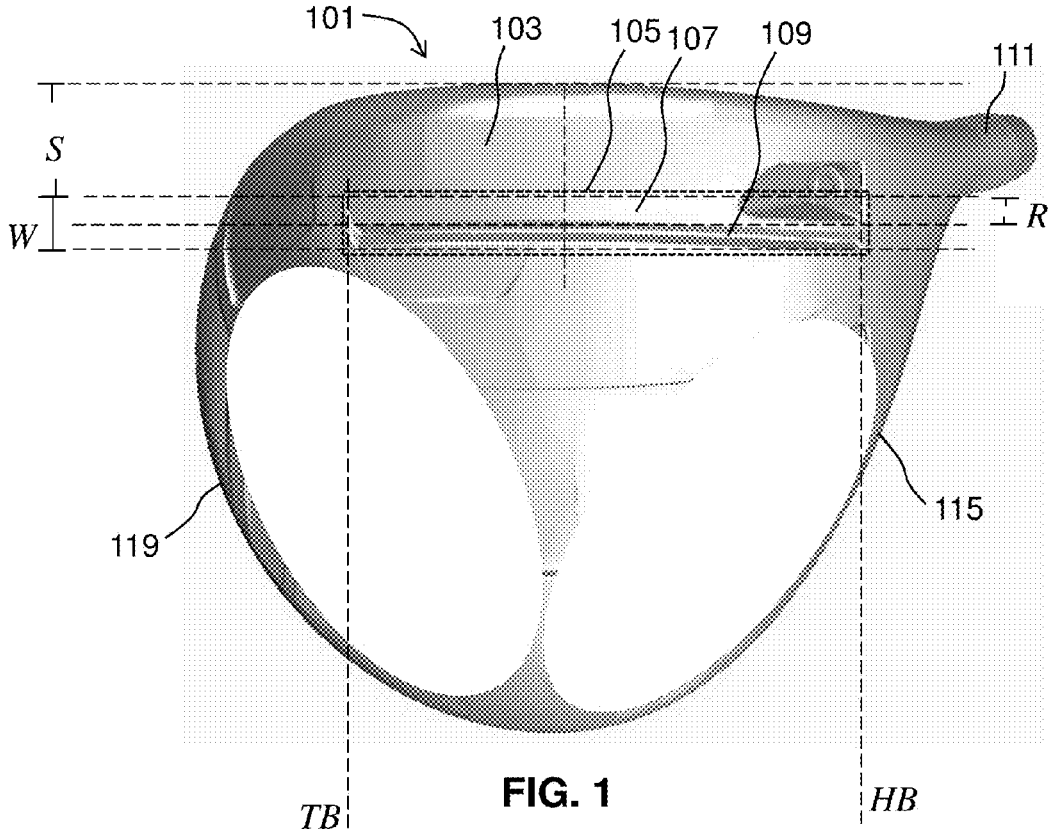
FIG. 1 is a view from below of a club head of the invention at address.

FIG. 1 shows a club head 101 of the invention. Club head 101 has a sole 103 extending between a heel side portion 115 and a toe side portion 119. Extending upward form club head 101 is hosel 111. Club head 101 further includes a channel area 105 extending along an outer surface of sole 103 from the heel portion towards the toe portion. Channel area 105 includes a ramp, or sloped area 107, defining a shallow slope (when club head 101 is at address) disposed alongside a groove 109.

Channel area 105 may be described according to dimension. A length of channel area 105 may be taken to be the distance between heel boundary HB and toe boundary TB. A width W of channel area 105 can be taken to be a distance between a foremost and aft-most part of sloped area 107 and channel 109. The foremost part of channel area 105 can be described as being spaced away from face 123 by a setback distance S. Sloped area 107 has a ramp width R measured within a horizontal plane when the club is at address and preferably between about 0.1 cm and about 5 cm. Groove 109 can be taken to have a width equal to W−R.

Figure 2:
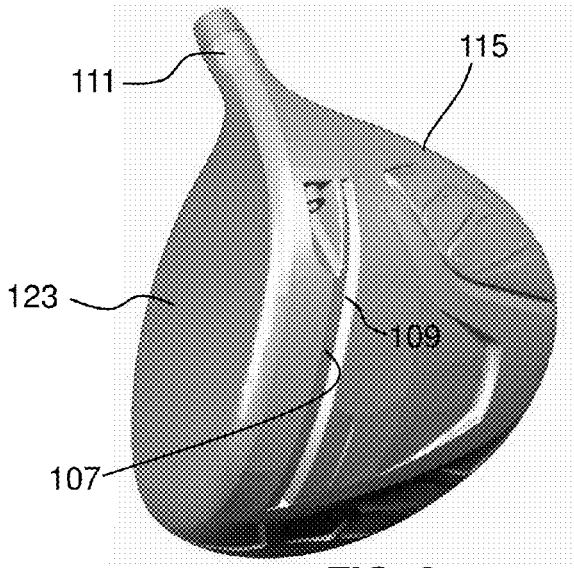
FIG. 2 is a lower perspective view of a club head of the invention.

FIG. 2 is a lower perspective view of club head 101 showing heel side portion 115 and face 123. As can be seen, sloped area 107 provides a ramp between a foremost portion of sole 103 and deeper groove 109.

Figure 3:
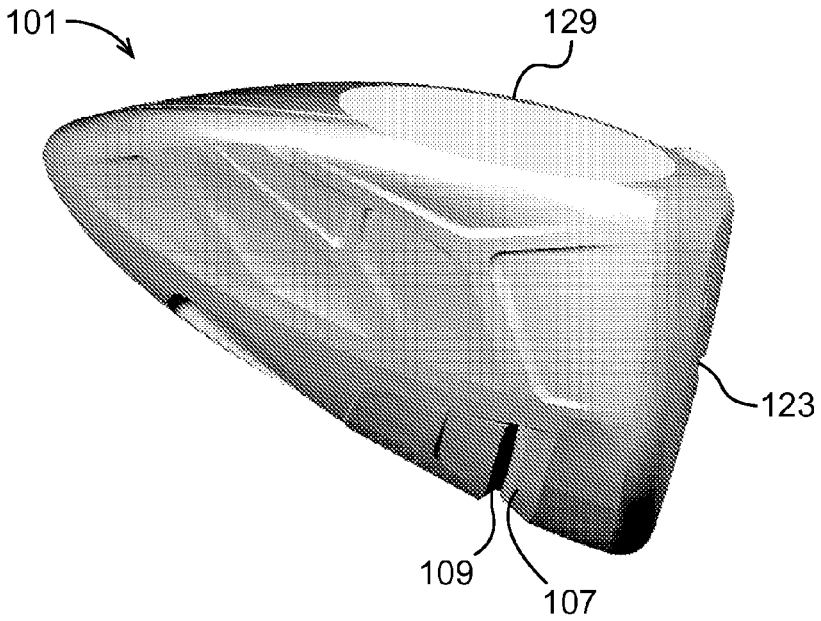
FIG. 3 is a toe-side view of a club head of the invention.

FIG. 3 give a toe-side view of club head 101 in profile, showing crown 129 and sole 103 extending back from face 123. Channel area 105 seen in this perspective reveals that sloped area 107 provides a gentle ramp upwards toward groove 109.

Figure 4:
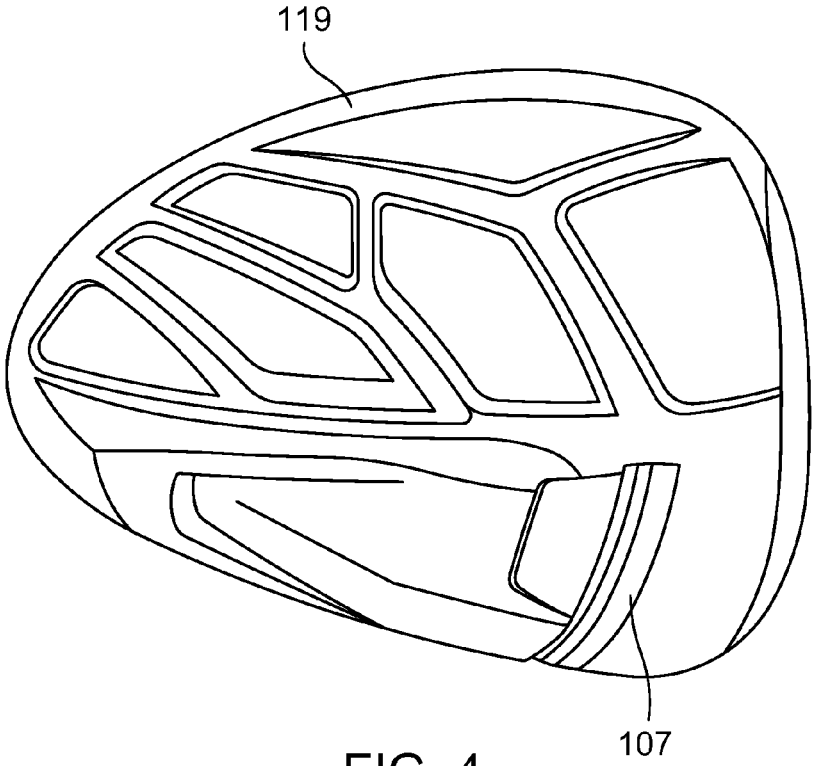
FIG. 4 gives an alternative view of a club head of the invention.

FIG. 4 shows channel area 105 from an angle, revealing that sloped area 107, groove 109, or both may curve around sole 103 from heel side 115 to toe side 119. Due to the fact that sloped area 107 curves around sole 103 and also slopes upwards at address, a surface of sloped area 107 may contain a portion of an idealized conical surface. The idealized conical surface defines an axis of a cone. The orientation of this axis relates to an ability of sloped area 107 to resist torsional stresses during a stroke. This axis may be substantially parallel to an axis of percussion of the club head. Alternatively, the axis may be parallel to a horizontal axis passing through a geometric center of face when the club head is at address. In fact, the axis may be located near but not precisely on a horizontal axis or an axis of percussion (e.g., anywhere intermediate to those axes). Orienting the curved plane of material provided by sloped area 107 in such a way disposes that material to resist non-uniform compression of club head due to the fact that vectors of torsional stress may lie substantially within or close to that curved plane. Other portions of sole 103 also provide planar areas of material that contain vectors of torsional stress. However, during the down stroke of a golf swing (FIG. 3 is useful for visualizing club head 101 in motion shortly before it reaches a ball), predominating vectors of torsional stresses on club head 101 may be oblique to planes of material provided by sole 103. In some embodiments, the invention provides a club head with a channel and any area of material disposed substantially along a flat or curved plane and adjacent the channel in which the area of material is inclined with respect to a predominant portion of the sole at an angle <180°. Preferably, this ramp is disposed between the sole and the channel and forms an angle with the sole (or with the horizontal when the club head is at address) that is between about 1° and about 80°. In fact, it may be found that the angle should most preferably be between about 5° and about 25°. Additionally, it may be preferable that the channel include at least one interior wall that is disposed more steeply than the ramp (e.g., between about 30° and about 60° with respect to the sole or the horizontal when the club head is at address). Preferably, channel area 105 extends substantially parallel to face area 123 and behind a sweet spot of the striking face.

Figure 5:
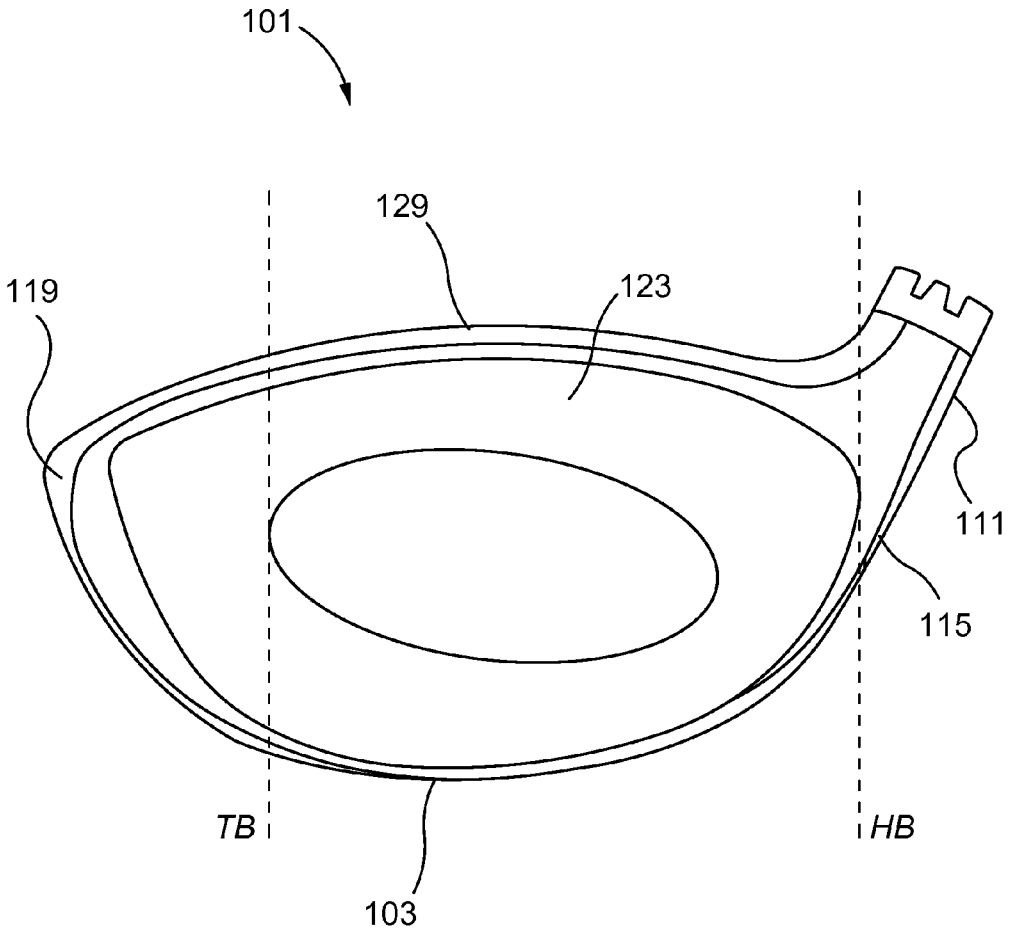
FIG. 5 shows a face of a club head of the invention.

FIG. 5 shows face of 123 of club head 101 with hosel 111 extending upwards at heel side portion 115 opposite from toe side portion 119. Channel area 105 (not visible in FIG. 5) extends along sole 103 from heel boundary HB to toe boundary TB. Boundaries HB and TB may be symmetrically disposed around a geometric center of face, disposed symmetrically around a club head center of gravity, or disposed asymmetrically.

In certain embodiments, including a channel area 105 on an outer surface of sole 103 will create a rib-like structure on an inside surface of sole 103. In particular, groove 109 having the form of a narrow furrow adjacent the inclined surface 107 may protrude upwards on an inside of sole 103.

Figure 6:
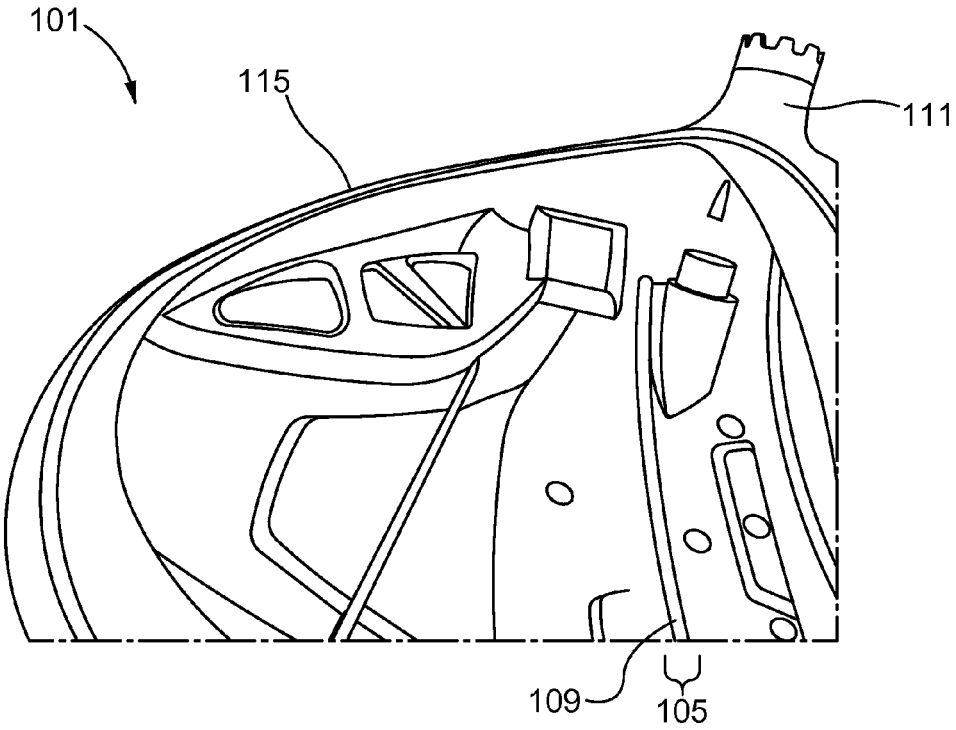
FIG. 6 is a cutaway view down into a heel-side of a club head of the invention.

FIG. 6 is a cutaway view showing an inside of heel portion 115 of club head 101. The narrow furrow of groove 109 is visible inside of the sole 103 as a ridge along the inside of the club head.

Figure 7:
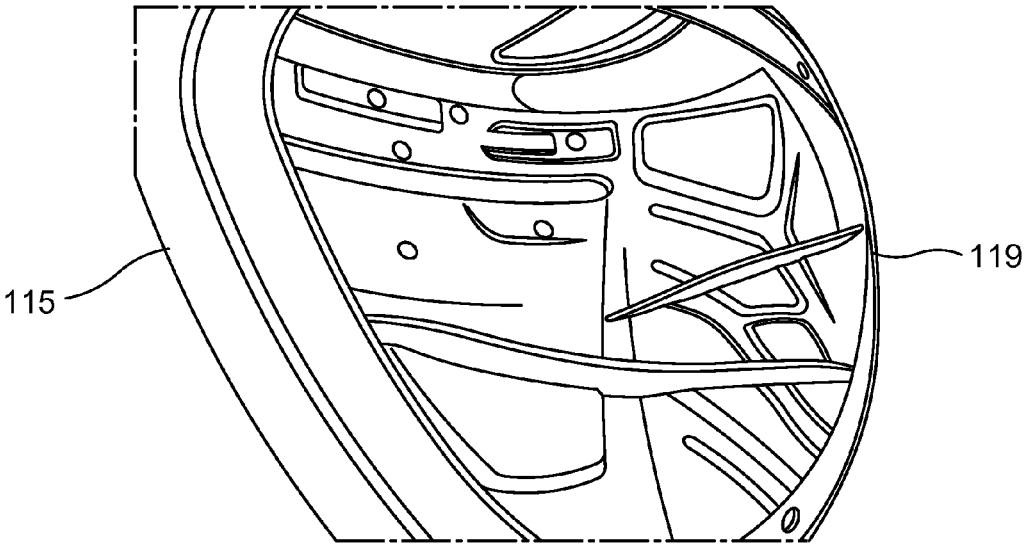
FIG. 7 is provides a cutaway view down into a toe-side of a club head of the invention.

FIG. 7 is provides a cutaway view down into toe portion 119 showing a toe-side terminus of the ridge corresponding to narrow furrow 109. Extending along the face-most side of the ridge is a gently sloped portion (not visible in FIGS. 6 and 7).

Figure 8:
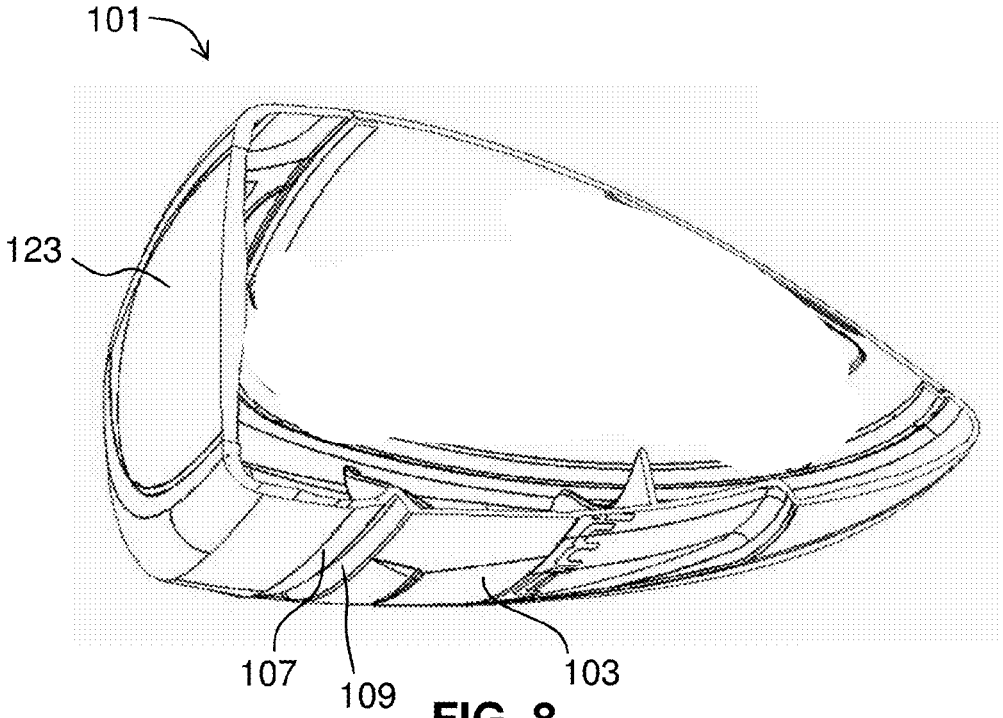
FIG. 8 shows a cutaway view from a heel side.

FIG. 8 gives a cutaway side view of club head 101 making visible the gently sloped portion that provides an inclined surface 107 transitioning from a downward-facing portion of the sole surface 103 to a narrow furrow 109 in the sole.

Figure 9:
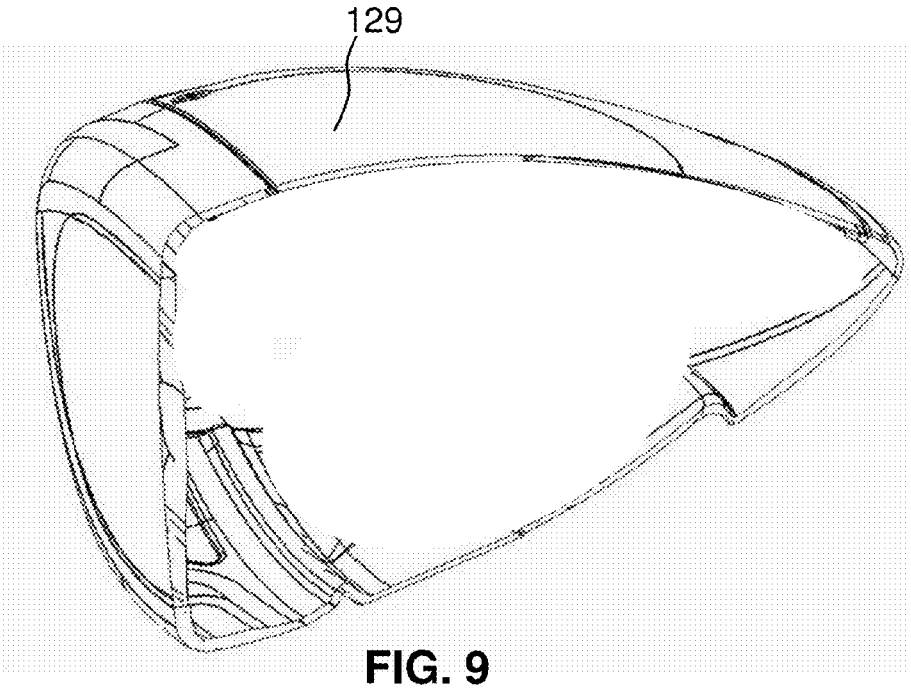
FIG. 9 gives another cutaway view.

FIG. 9 gives another cutaway view. As can be seen in FIGS. 8 and 9, club head 101 also includes crown 129 and face 123, which cooperate with sole 103, heel portion 115 and toe portion 119 to define a club head body. Channel area 105 may be included in any style of club head including one or more of a putter, a wedge, an iron, a hybrid, a fairway wood, a driver (either hollow or solid wood type). Due to the high speed drives or other fairway strokes and the nature of material compression, it may be preferable to include a channel area 105 in a hollow club head 101 such as a driver, fairway wood, or hybrid. In certain embodiments, crown 129, sole 103, heel portion 115, toe portion 119, and face 123 cooperate to define a hollow, enclosed club head body having hosel 111 extending upwards therefrom. Sole 103 includes channel area 105, which may be described as having an inclined surface 107 transitioning from a downward-facing portion of a surface of sole 103 to a narrow furrow or groove 109 into sole 103. It may be most preferable to include channel area 105 in a hollow, enclosed club head such as a driver to dampen and inhibit the adverse torsional strains that would otherwise result from torsional stresses in high-speed swings such as drives.

Channel area 105 may be described with respect to a section (i.e., a drawing of club head 101, sole 103, or channel area 105 as it would appear if cut straight through in a given plane).

Figure 10A:
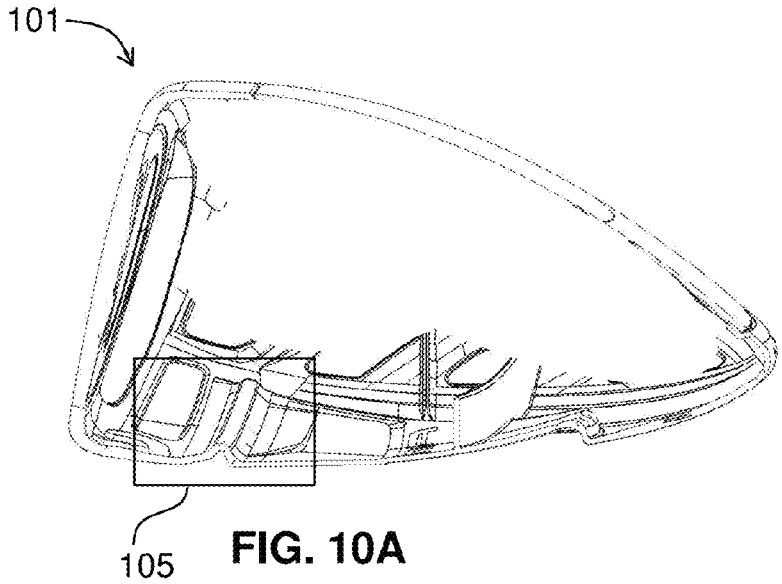
FIG. 10A gives a side cutaway view.

FIG. 10A is a section of club head 101 where the sectional plane is a plane that is vertical when club head 101 is at address and passes substantially through a center of club head 101. Club head 101 includes channel area 105 shown in a box drawn on FIG. 10A.

Figure 10B:
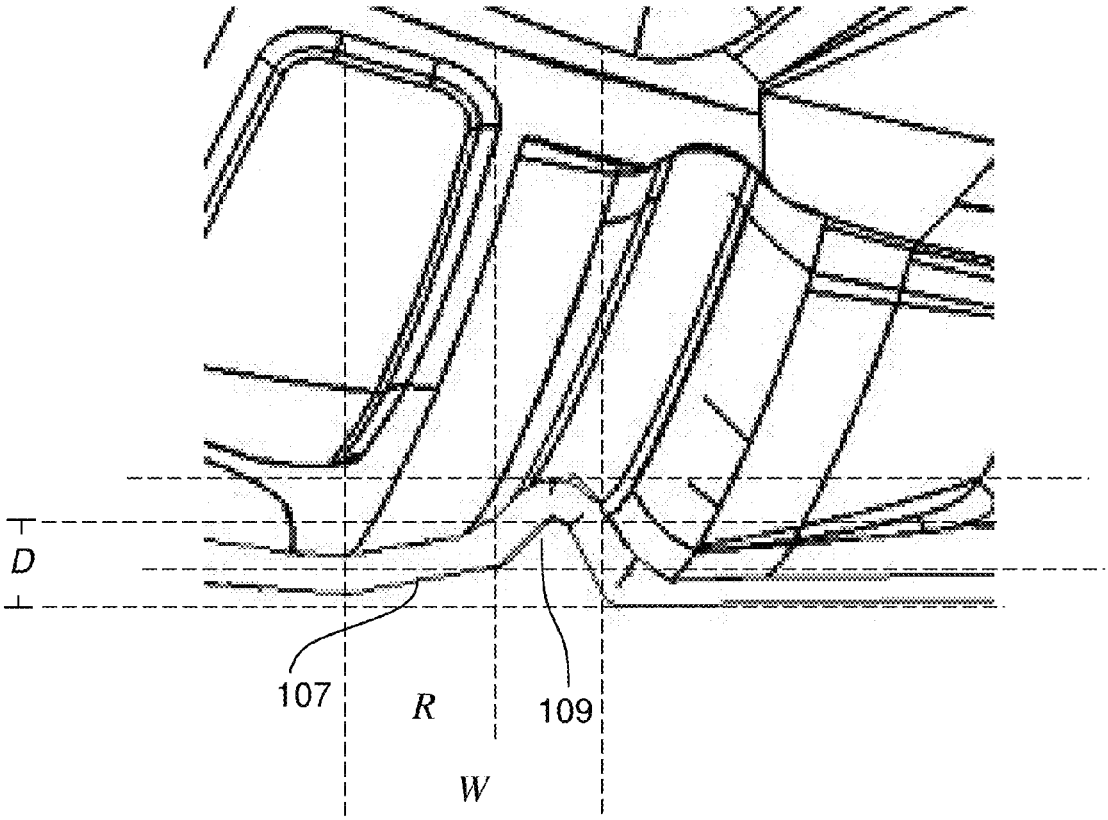
FIG. 10B gives a detailed view of a portion of FIG. 10A.

FIG. 10B is a section through the area of channel area 105 that is enclosed by the box drawn on FIG. 10A. Channel area 105 includes a gently inclined portion 107 forming a first angle with the horizontal alongside a channel 109 that has a steeply inclined portion forming a second angle with the horizontal. If club head 101 were held at address resting on flat, planar ground, the highest point within the open space of channel area 105 defines a depth D of a channel in sole 103. The gently inclined portion 107 has a ramp width R extending from the face-most point of the inclined portion 107 to the transition from the inclined portion 107 to the channel 109. The gently inclined portion 107 and the channel 109 may provide surfaces that can be described with reference to the horizontal when the club head is at address.

Figure 10C:
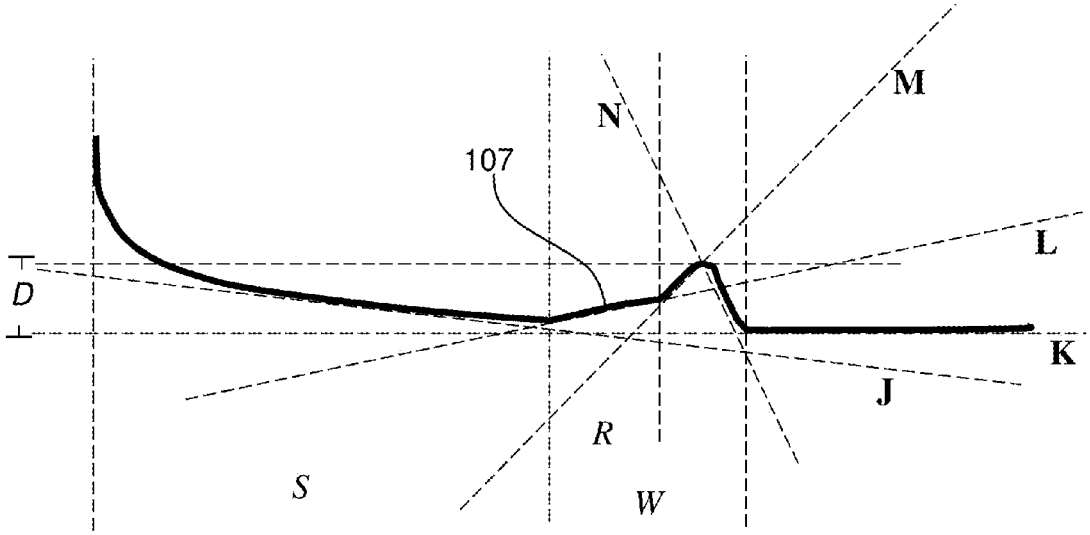
FIG. 10C shows a portion of a section of a sole surface from the view of FIG. 10A.

FIG. 10C is a detail view of a section of a surface of sole 103. Gently inclined portion 107 substantially extends along a line L that lies within the section (i.e., lies within the plane of the page of FIG. 10C). The horizontal defines a line K within the section. Channel 109 preferably contains at least two oppose and inward-facing walls. An aft-facing wall substantially meets a line M that lies within the section. A fore-facing wall substantially meets a line N that lies within the section. A predominant portion of sole 103 just forward of channel area 105 lies along line J that lies within the section. Lines J, K, L, M, and N as well as depth D, ramp distance R, channel area width W and setback S provide references for describing aspects of channel area 105.

Figure 10D:
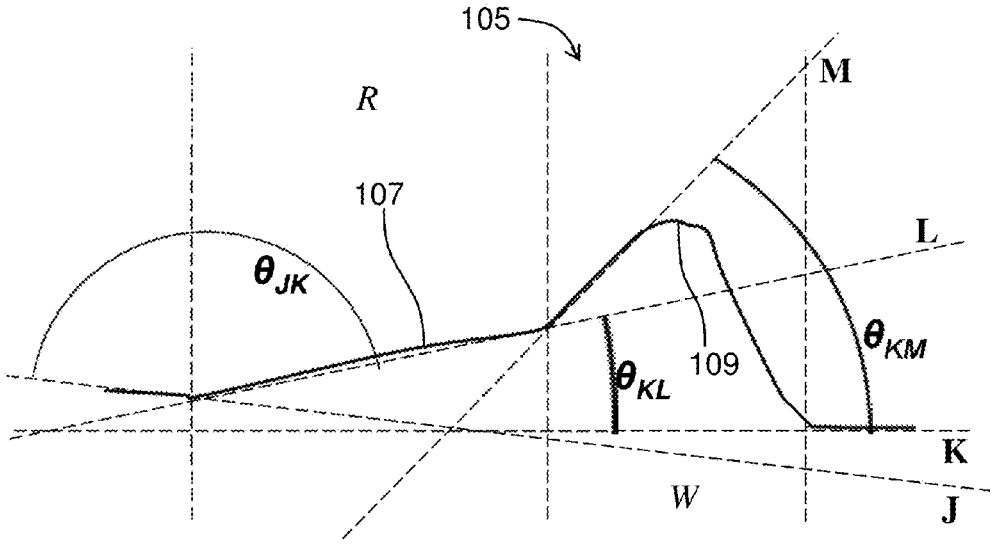
FIG. 10D gives a close-up view of the surface section shown in FIG. 10C.

FIG. 10D gives a close-up view of the surface section shown in FIG. 10C. Gently inclined portion 107 may form an angle $\theta_{JK}$ with a predominant portion of sole 103 just forward of channel area 105. It may be preferable that $\theta_{JK}$ is between about 10° and about 25° to optimize bounce angle. Gently inclined portion 107 may form an angle $\theta_{KL}$ with the horizontal. It may be preferable that $\theta_{KL}$ is between about 5° and about 20° to optimize torsional rigidity. An aft-facing wall of channel 109 may form an angle $\theta_{KM}$ with the horizontal. It may be preferable that $\theta_{KM}$ is between about 30° and about 60° to optimize the contribution of the steeply inclined portion of channel 109 to a coefficient of restitution of face 123.

One significant improvement over prior art structures may be provided by a channel that has two adjacent wall portions, a first with a shallow slope angle $\theta_{KL}$ and a second with a steeper slope angle $\theta_{KM}$. Particularly in cooperation with sole 103, these areas lying substantially within a plane or a curved plane may add planar material that resists stress in a plurality of different vectors. It may be found that the shallow slope angle $\theta_{KL}$ should be between about 1° and about 20° and that the steep slope angle $\theta_{KM}$ should be between about 20° and about 70°. Additionally, those portions are described here as defining angles, but they need not be surfaces that extend strictly within planes. Gently curved or rolled surfaces are included within the scope of the invention as are areas in which the gently inclined portion 107 curves continually into the steeply inclined portion. In certain aspects, the invention provides a club head in which a cross-sectional profile of a portion of a channel area 105 has, when the club head is at address, a gently inclined portion 107 disposed at an angle to the horizontal and a steeply inclined portion disposed at a second angle to the horizontal and in which the gently and steeply inclined portions are each and all substantially curved forming a continually curving cross sectional profile.

Golf club heads of the invention can be made by methods and materials known in the art.

Figure 11:
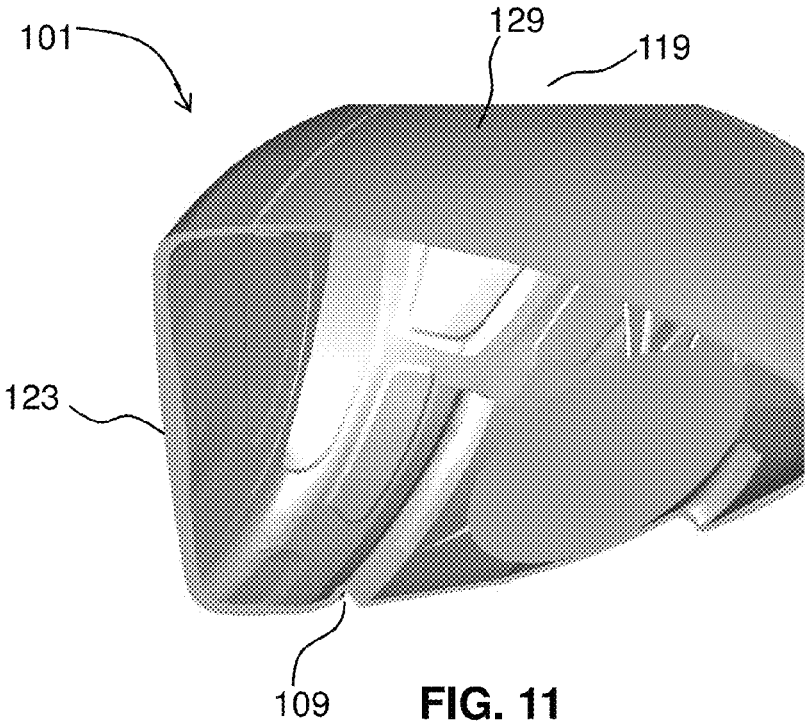
FIGS. 11 and 12 give additional cutaway views.
Figure 12:
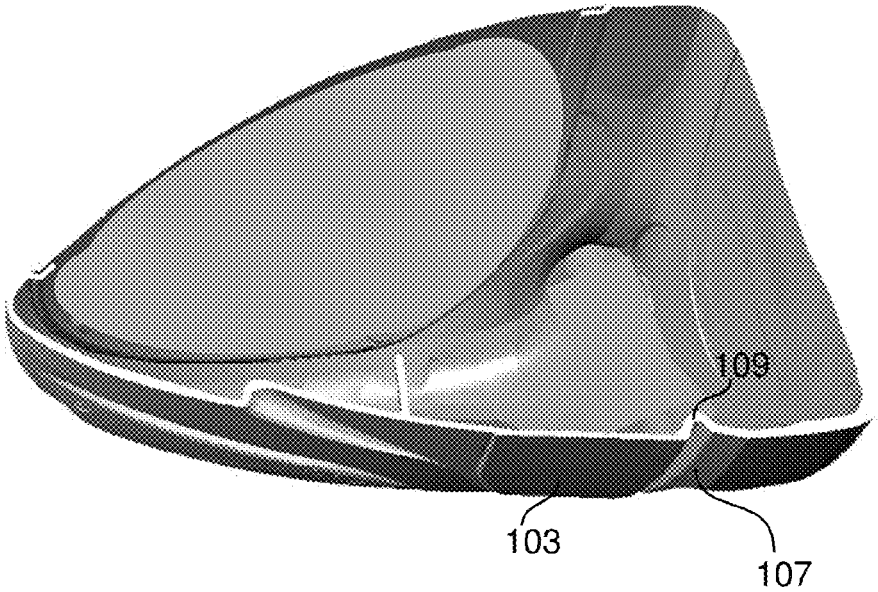

FIGS. 11 and 12 show club head 101 having a body that provides a hollow, enclosed shell. Club head 101 can include metals, plastics, other materials, or a combination thereof. Materials can include titanium, aluminum, other metals, alloys thereof, any plastic or thermoplastic, laminate, or prepreg, carbon fiber, extruded materials, or combinations thereof. Panels of the walls can have layered or sandwiched constructions. Components can be formed by casting, stamping, forging, molding, co-molding, machining, milling, CNC manufacturing, hand-forming, other methods, or combinations thereof. Club head 101 may include other useful features such as weight members, inserts, structural ribs, construction seams, connection hardware, etc. Components may be assembled by adhesives, welding, mechanical fasteners, co-molding, other methods, or combinations thereof.

Construction of club head 101 may be via known methods. U.S. Pat. No. 7,294,064; U.S. Pat. No. 8,529,368 to Rice; U.S. Pat. No. 7,582,024 to Shear; U.S. Pat. No. 7,572,193 to Yokota; U.S. Pat. No. 7,500,924 to Yokota; U.S. Pat. No. 7,396,293 to Soracco; U.S. Pat. No. 6,887,165 U.S. Pat. No. 5,735,754 to Antonious; U.S. Pat. No. 5,603,668 to Antonious; U.S. Pat. No. 1,835,718 to Morton; U.S. Pub. 2013/0029779 to Stites; U.S. Pub. 2012/0143452 to Burnet; U.S. Pub. 2012/0142447 to Boyd; U.S. Pub. 2012/0196703 to Sander; U.S. Pub. 2012/0244960 to Tang; U.S. Pub. 2012/0220387 to Beach; U.S. Pub. 2007/0117648 to Yokota; U.S. Pub. 2007/0026961 to Hou; U.S. Pub. 2004/0192463 to Ando; and U.S. Pub. 2002/0183134 to Allen show features and constructions that may be modified for incorporation in a club head of the invention and the content of each of those references is incorporated by reference for all purposes.

As used herein, the word "or" means "and or or", sometimes seen or referred to as "and/or", unless indicated otherwise.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head comprising:

a crown, sole, heel portion, toe portion, and face cooperating to define a club head body;

a hosel extending upwards from the body; and a channel extending along an outer surface of the sole from the heel portion towards the toe portion, the channel comprising:

a ramp with a surface that is sloped with respect to the horizontal when the club head is at address, and a groove disposed alongside the ramp, the groove comprising a fore facing inward wall and an aft-facing inward wall, wherein the aft-facing inward wall is sloped in the same direction as, but more steeply than, the surface of the ramp with respect to the horizontal when the club head is at address.

2. The club head of claim 1, wherein the club head is a hollow club head.

3. The club head of claim 1, wherein the club head is a driver-style club head.

4. The golf club of claim 1, wherein the surface of the ramp is sloped at an angle between 5° and 20° and the aft-facing inward wall is sloped at an angle between 20° and 80°, with respect to the horizontal when the club head is at address.

5. The golf club of claim 1, wherein the surface of the ramp is sloped at an angle between 10° and 20° and the aft-facing inward wall is sloped at an angle between 30° and 60°, with respect to the horizontal when the club head is at address.

6. The golf club of claim 5, wherein a heel-toe length of the channel is between about 5 cm and about 15 cm and a face-aft width of the channel is between about 0.2 cm and about 3 cm.

7. The golf club of claim 6, wherein a face-aft width of the ramp is between about 0.1 cm and about 1.5 cm.

8. A hollow driver-type club head golf club head comprising:

a crown, sole, heel portion, toe portion, and face cooperating to define a club head body;

a hosel extending upwards from the body; and a channel extending across the sole in a heel-toe direction, wherein a cross-sectional profile of the channel, when the club head is at address, comprises:

a gently inclined portion forming a first angle between 5° and 20° with the horizontal, an aft-facing wall defining a steeply inclined portion and forming a second angle between 20° and 80° with the horizontal, and a fore-facing wall.

9. The club head of claim 8, wherein the channel is substantially parallel to the face and spaced away from the face by at least a setback distance over a majority of a length of the channel, wherein the setback distance is between about 1 cm and about 5 cm.

10. The club head of claim 9, wherein the channel comprises a depth, with respect to a predominant surface of the sole, between about 5 mm and about 10 mm.

* * * * *